US006101823A

United States Patent [19]

Chiu et al.

[11] Patent Number: 6,101,823

[45] Date of Patent: Aug. 15, 2000

[54] EVAPORATIVE CONDENSING APPARATUS

[75] Inventors: Peng-Chu Chiu; Tsui-Ling Hsuen, both of Hsinchu; Chih-Hsien Huang, Hsinchu Hsien, all of Taiwan

[73] Assignee: Nutec Electrical Engineering Co., Ltd., Taipei, Taiwan

[21] Appl. No.: 09/168,940

[22] Filed: Oct. 9, 1998

[51] Int. Cl.[7] ..... F28D 3/00

[52] U.S. Cl. ..... 62/171; 62/183; 62/305; 62/DIG. 17; 165/113; 261/140.2

[58] Field of Search ..... 62/171, 305, 181, 62/183, 184, 315, 316, DIG. 17; 165/113, 104.11; 261/140.1, 140.2

[56] References Cited

U.S. PATENT DOCUMENTS

| | | | |
|---|---|---|---|
| 2,048,902 | 7/1936 | Velut | 257/55 |
| 3,099,915 | 8/1963 | Andersson | 62/305 |
| 3,116,612 | 1/1964 | Pennington | 62/171 |
| 3,313,120 | 4/1967 | Kuss et al. | 62/188 |
| 3,435,631 | 4/1969 | Wood, Jr. | 62/305 |
| 4,090,370 | 5/1978 | Vaughan | 62/91 |
| 4,170,117 | 10/1979 | Faxon | 62/183 |
| 4,193,269 | 3/1980 | Barry | 62/171 |
| 4,240,265 | 12/1980 | Faxon | 62/171 |
| 4,266,406 | 5/1981 | Ellis | 62/183 |
| 4,438,635 | 3/1984 | McCoy, Jr. | 62/305 |
| 4,552,303 | 11/1985 | Fisher et al. | 236/44 |
| 4,576,012 | 3/1986 | Luzenberg | 62/157 |
| 4,932,218 | 6/1990 | Robbins | 62/171 |
| 4,968,457 | 11/1990 | Welch | 261/39.1 |
| 5,084,217 | 1/1992 | Dodds | 261/36.1 |
| 5,106,543 | 4/1992 | Dodds | 261/36.1 |
| 5,117,644 | 6/1992 | Fought | 62/171 |
| 5,390,502 | 2/1995 | Storbeck et al. | 62/91 |
| 5,401,419 | 3/1995 | Kocib | 210/697 |
| 5,411,078 | 5/1995 | Ares | 165/113 |
| 5,444,991 | 8/1995 | Cox | 62/305 |
| 5,605,052 | 2/1997 | Middleton et al. | 62/171 |

*Primary Examiner*—William Doerrler
*Assistant Examiner*—Marc Norman
*Attorney, Agent, or Firm*—Rosenberg, Klein & Lee

[57] ABSTRACT

An evaporative condensing apparatus used in an air conditioner to reduce the power consumption of the air conditioner and improves its EER value. The evaporative condensing apparatus is based on the rule that the condensing temperature is directly proportional to the condensing pressure during the exchange of a cooling agent between liquid state and gas state. The evaporative condensing apparatus includes an evaporative condensing unit for condensing a gas state cooling agent into a liquid state, the evaporative condensing unit having a plurality of condenser coils and absorptive means covered on the condenser coils, a low compression ratio compressor controlled to pump a gas state cooling agent into the evaporative condensing unit, a water supply system having a control PC board and an electromagnetic valve controlled by the control PC board to let cooling water be delivered from a water source to the layer of absorptive material of each condenser coil, and a condenser fan controlled to draw currents of air through gaps in the condenser coils of the evaporative condensing unit in carrying heat away from the evaporative condensing unit.

4 Claims, 10 Drawing Sheets

EVAPORATIVE CONDENSING APPARATUS

BACKGROUND OF THE INVENTION

The present invention relates to an evaporative condensing apparatus for use in an air conditioner (cooler), and more particularly to such an evaporative condensing apparatus which greatly improve the working efficiency of the air conditioner (cooler).

Air conditioners (coolers) are intensively used in most countries in summer for air-conditioning buildings, rooms, trains, cars, etc. When an air conditioner is operated, it consumes much energy. In a regular air conditioner, a liquid state cooling agent is guided to an evaporator to make a heat exchange with air, permitting cooling air to be guided into the inside space of a building, room, train or car. After a heat exchange process, the liquid state cooling agent is changed into a gas state cooling agent, the gas state cooling agent is then compressed by a compressor and pumped to a condenser where the gas state cooling agent is returned to the liquid state again. Further, the condensing units of conventional air conditioners include three types, namely, the air cooling type, the water cooling type and the evaporative type. An air cooling type air conditioner uses convention currents of air to carry heat away from its condensing unit. In order to let heat be quickly carried away, much air contact surface and high currents of air are needed. Therefore, an air cooling type air conditioner is heavy, consumes much energy, and produces high noise during its operation. A water cooling type air conditioner uses cooling water to carry heat away from its condensing unit. However, a water cooling type air conditioner is expensive, and consumes much cooling water. Further, the installation of a water tower for a water cooling type air conditioner is complicated, and may cause an American veteran syndrome. An evaporative type air conditioner dissipates heat by means of evaporation of water (one liter of water absorbs about 539 cal. when evaporated). The heat dissipation effect of an evaporative type air conditioner is much better than an air cooling type air conditioner and a water cooling type air conditioner. However, when an evaporative type air conditioner is used, water storage means is needed to collect waste water that is not evaporated at the evaporative condensing unit of the air conditioner.

SUMMARY OF THE INVENTION

The present invention has been accomplished to provide an evaporative condensing apparatus for an air conditioner which eliminates the aforesaid drawbacks. It is one object of the present invention to provide an evaporative condensing apparatus which enables supplied cooling water to be fully evaporated so that heat can be efficiently carried away during its operation. It is another object of the present invention to provide an evaporative condensing apparatus which is compact, has all in it, and can conveniently be installed in an air conditioner. According to one aspect of the present invention, the evaporative condensing apparatus comprises an evaporative condensing unit for condensing a gas state cooling agent into a liquid state, the evaporative condensing unit having a plurality of condenser coils and absorptive means covered on the condenser coils, a low compression ratio compressor controlled to pump a gas state cooling agent into the evaporative condensing unit, a water supply system having a control PC board and an electromagnetic valve controlled by the control PC board to let cooling water be delivered from a water source to the layer of absorptive material of each condenser coil, and a condenser fan controlled to draw currents of air through gaps in the condenser coils of the evaporative condensing unit in carrying heat away from the evaporative condensing unit. According to another aspect of the present invention, the condenser coils each comprise a metal coil tube and a layer of absorptive material covered on the periphery of the metal coil tube, and the water supply system comprises a plurality of water spray tubes and absorptive material covered on the water outlets of the water spray tubes for permitting supplied cooling water to be evenly smoothly distributed to the absorptive material at the condenser coils.

DETAILED DESCRIPTION OF THE PREFERRED EMBODIMENT

Figure 1:
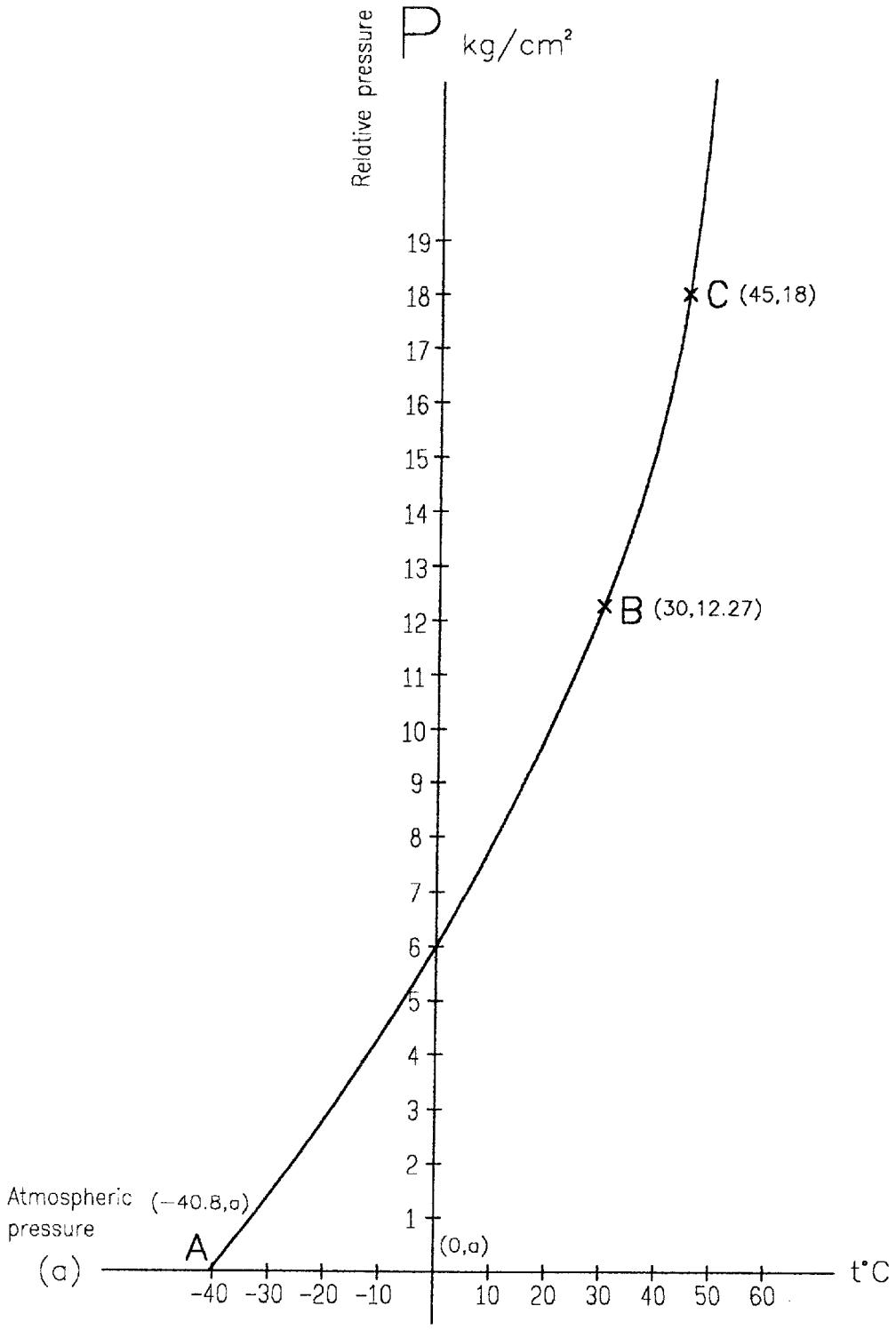
FIG. 1 is a liquid-gas curve obtained from R-22 cooling agent.

FIG. 1 is liquid-gas curve obtained from R-22 cooling agent. As indicated, the cooling agent can easily be condensed with low condensing pressure when at a low temperature, for example: when at 45° C., the theoretical value of relative pressure is about 18 kg/cm$^2$; if the temperature drops to 30° C., the theoretical value of relative pressure can drastically be reduced to 12.27 kg/cm$^2$. Therefore, reducing the working pressure of the compressor of the condensing apparatus of an air conditioning or refrigerating system can greatly save the consuming power (horsepower), which drives the compressor, so as to improve the EER of the air conditioning or refrigerating system. The present invention is based on the rule that the condensing temperature is directly proportional to the condensing pressure during the exchange of a cooling agent between liquid state and gas state.

Figure 2:
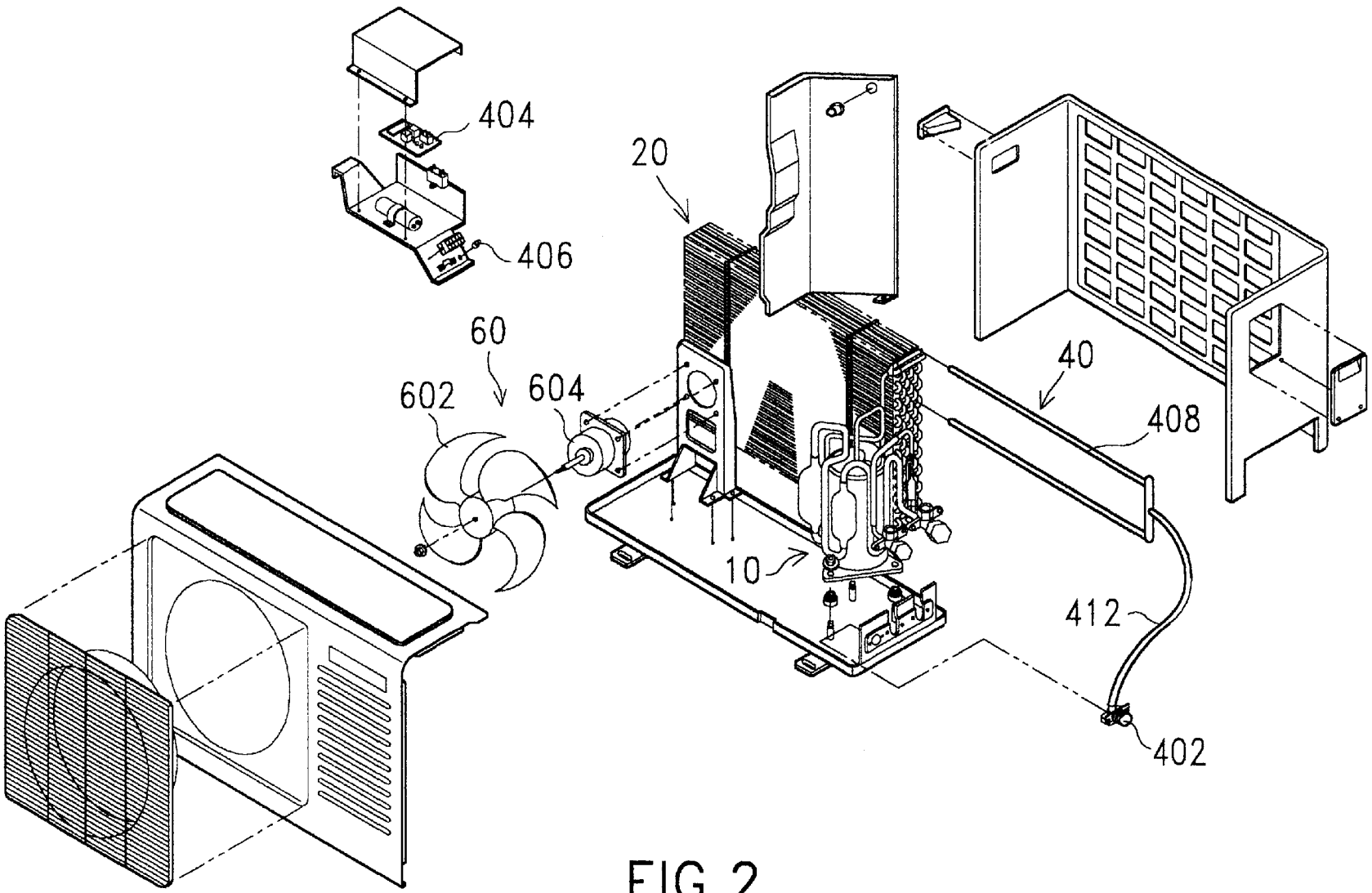
FIG. 2 is an exploded view of an air conditioner constructed according to the present invention.
Figure 3:
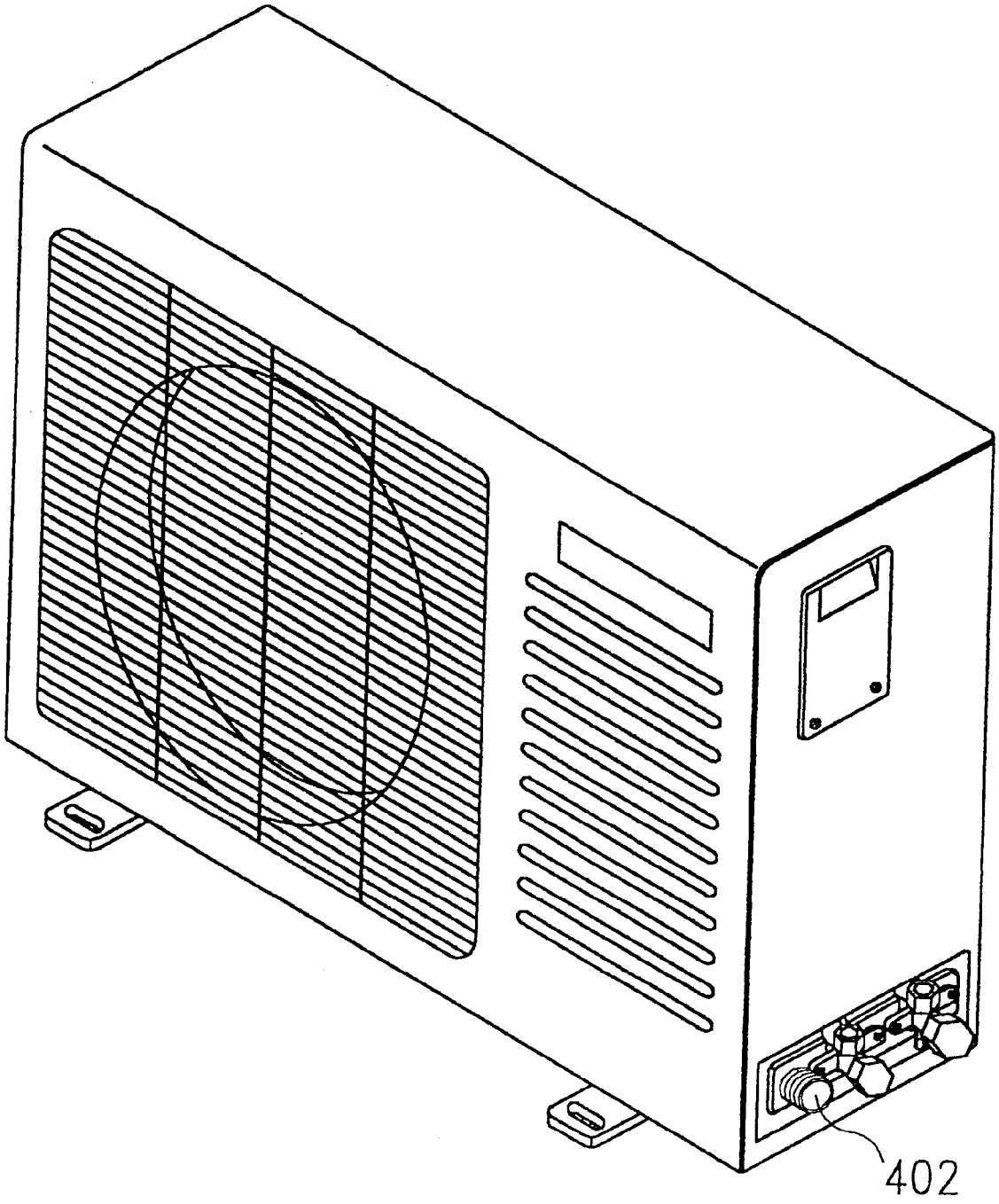
FIG. 3 is an elevational view of the air conditioner shown in FIG. 2.

Referring to FIGS. 2 and 3, a low compression ratio compressor 10 is operated to pump a high pressure, high temperature, gas state cooling agent into an evaporative condensing unit 20, permitting it to be condensed into liquid state. A water supply system 40 is controlled by a control PC board 404 to periodically supply water to the evaporative condensing unit 20. A condenser fan 60 which is comprised of a fan motor 604 and a fan blade unit 602 is controlled to causes currents of air through air passages in the evaporative condensing unit 20, causing heat and moisture to be quickly carried away from the evaporative condensing unit 20. The control PC board 404 comprises a water pressure selector switch for High, Medium, Low water pressure selections. The control PC board 404 controls an electromagnetic valve 402 of the water supply system 40, causing the electromagnetic valve 402 to be closed/opened subject to the operation cycle of the compressor 10, so that sufficient water can be supplied to the evaporative condensing unit 20 to cool down the cooling agent and the compressor 10. During the operation of the compressor 10, supplied water is evaporated with heat, and residual water, if any, is collected for a repeated use. The electromagnetic valve 402 controls the water passage between the water source, which can be for example water works, and the water supply pipe, referenced by 412, of the water supply system 40. The water supply system 40 further comprises a manual switch 406, which is controlled to let water be continuously supplied for washing the machine, and a plurality of water spray tubes 408 respectively connected to the water supply pipe 412 and installed in the evaporative condensing unit 20.

Figure 4:
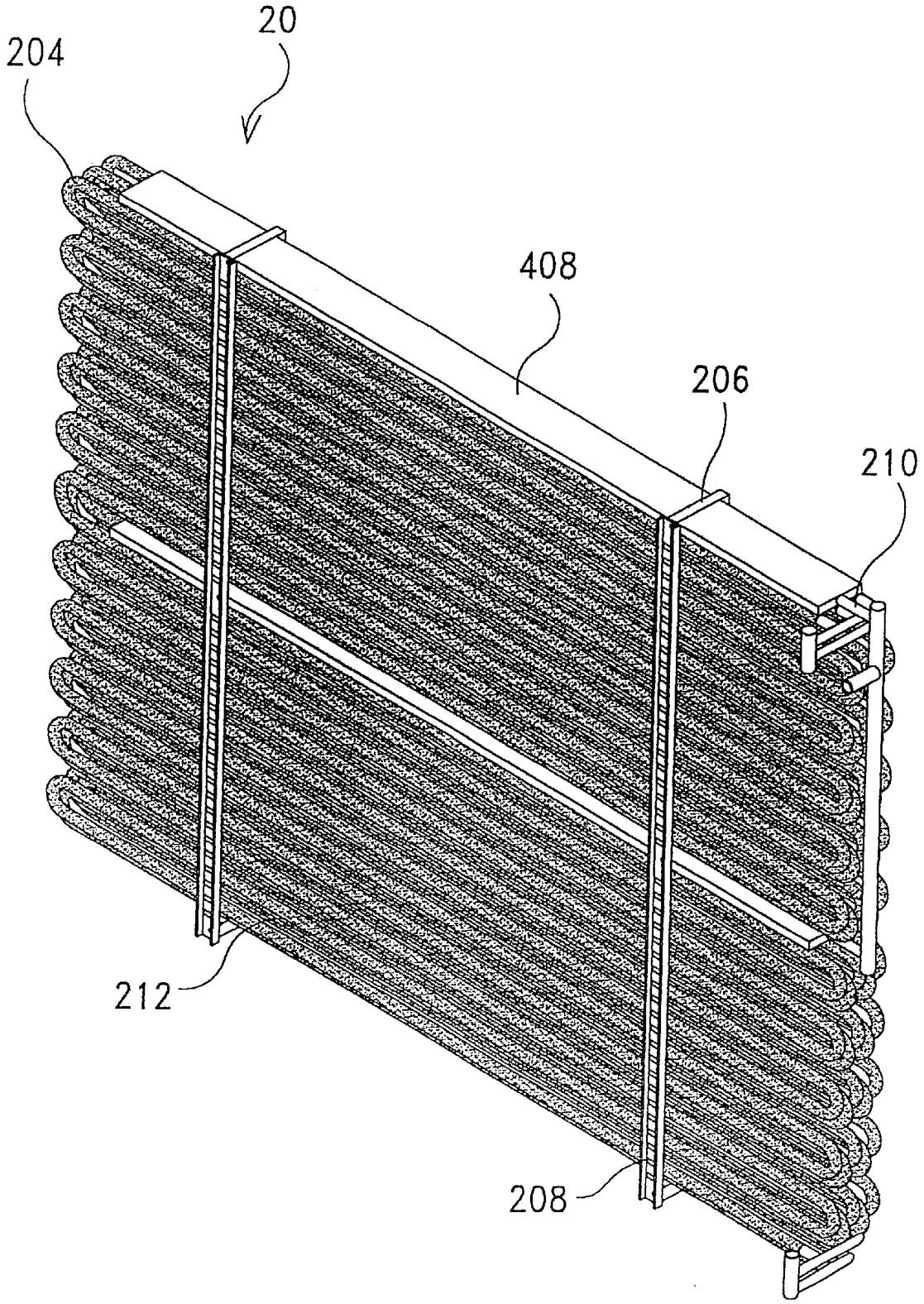
FIG. 4 is a perspective view of an evaporative condensing unit according to the present invention.
Figure 5:
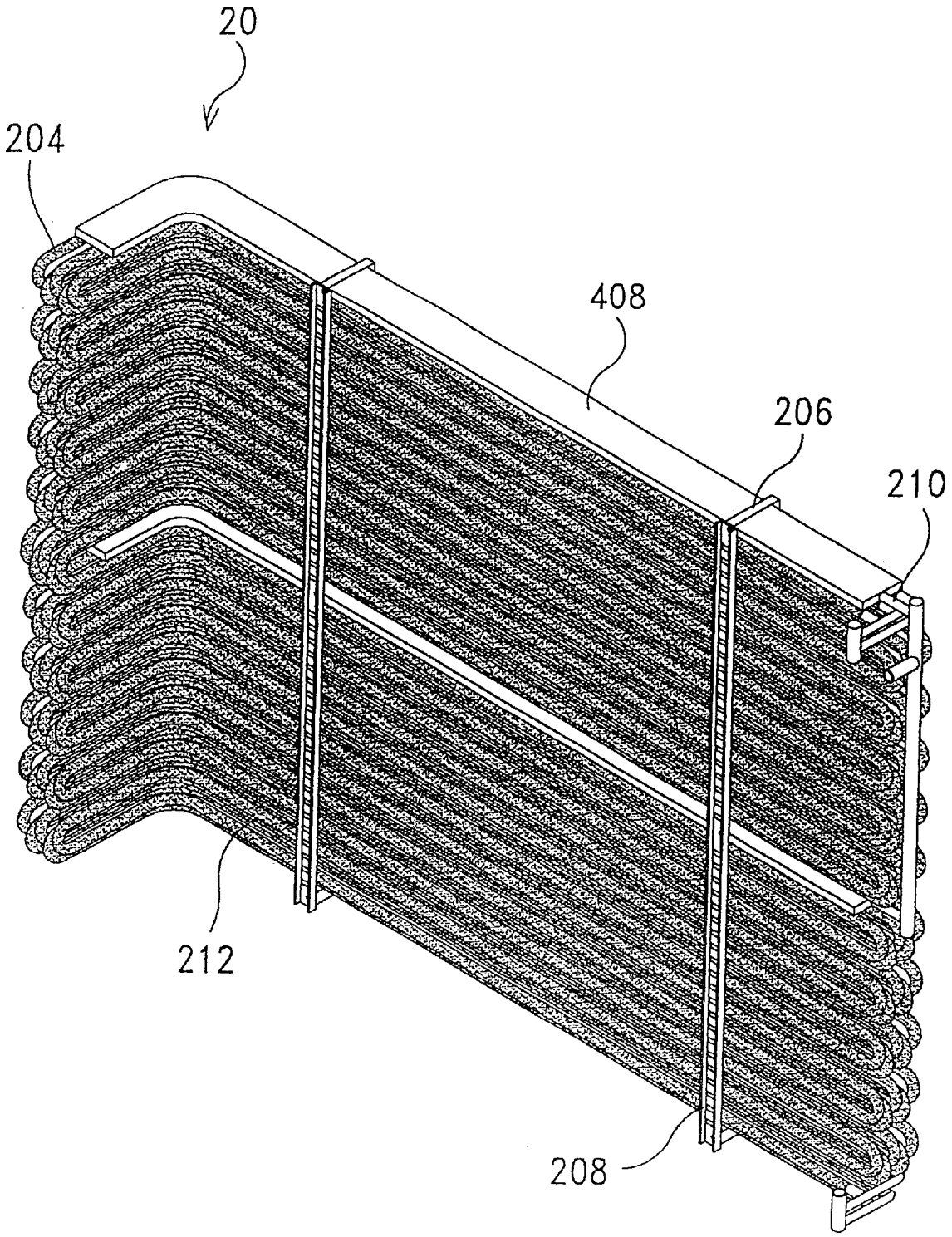
FIG. 5 is a perspective view of an alternate form of the evaporative condensing unit according to the present invention.
Figure 6:
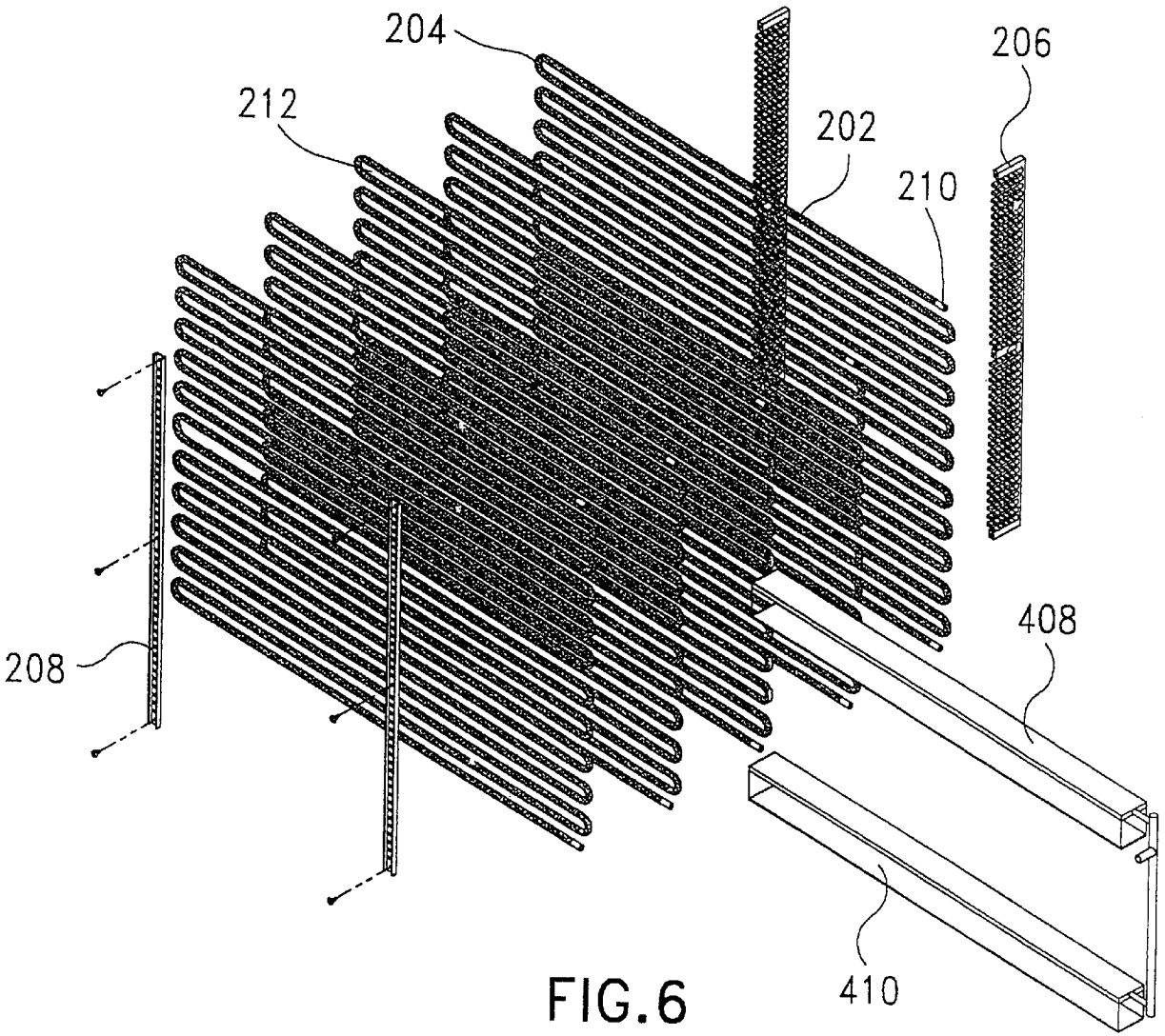
FIG. 6 is an exploded view of the evaporative condensing unit shown in FIG. 4.

Referring to FIGS. 4 and 5, the evaporative condensing unit 20 can have a straight shape as shown in FIG. 4, or a curved shape as shown in FIG. 5. The evaporative condensing unit 20 is comprised of a plurality of supporting frames 206, a plurality of independent condenser coils 204 fastened to the supporting frames 206 and arranged in parallel or a staggered manner for circulation of a cooling agent, the condenser coils 204 being respectively covered with absorptive material 202 and defining a plurality of air gaps 212 between sections thereof, a plurality of packing frames 208 respectively fastened to the supporting frames 206 by screws to secure the condenser coils 204 and the supporting frames 206 together. Further, the water spray tubes 408 of the water supply system 40 (see also FIG. 2) are respectively fastened to the supporting frames 206 at different elevations, and controlled to spray water over the condenser coils 204. The water spray tubes 408 are respectively covered with absorptive material 410, so that sprayed water can be absorbed by absorptive material 410 and then evenly smoothly distributed over the condenser coils 204.

Figure 7:
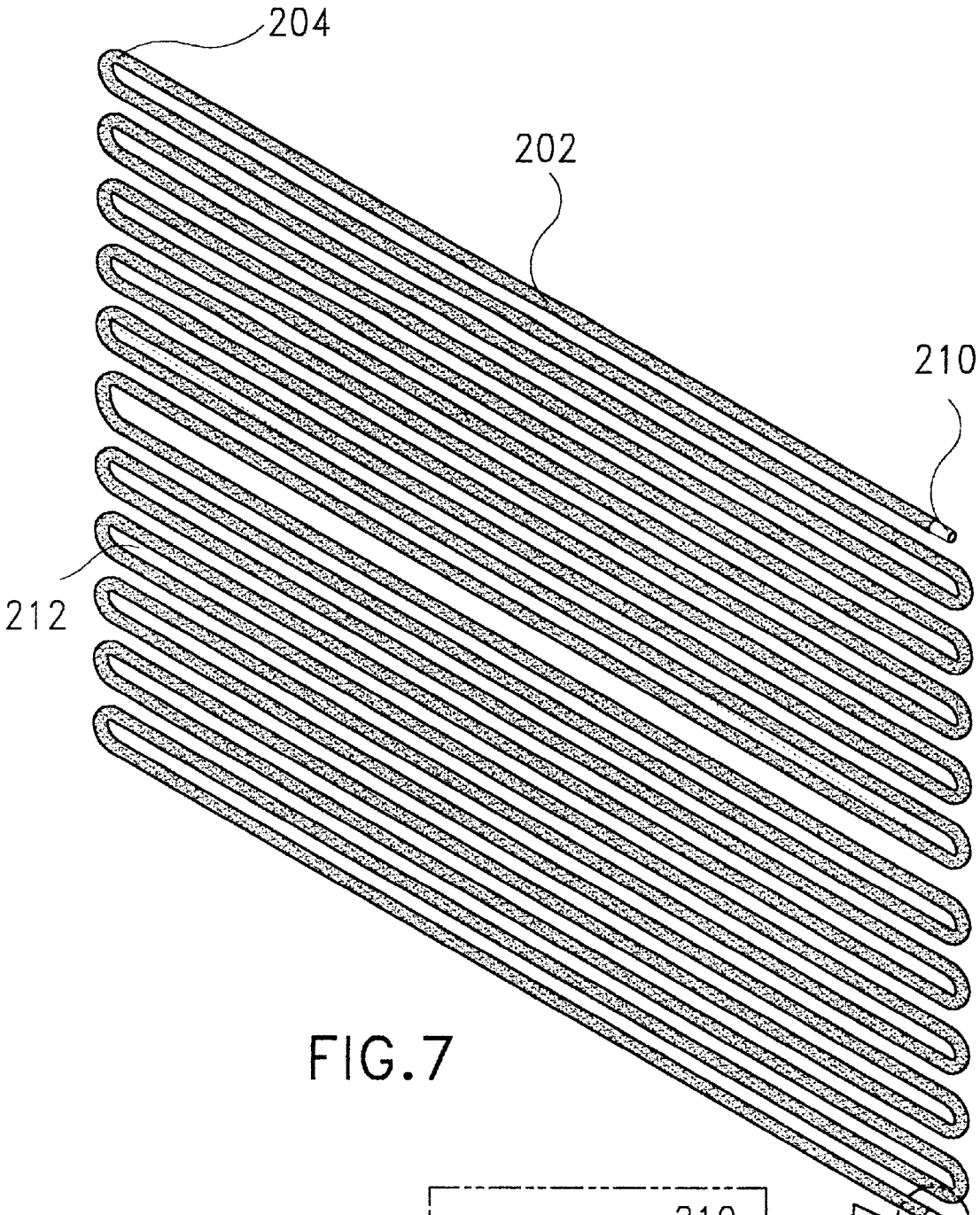
FIG. 7 is a perspective view of a condenser coil according to the present invention.
Figure 7A:
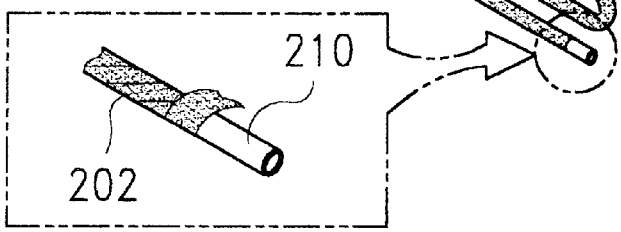
FIG. 7A is an enlarged view of a part of FIG. 7.

Referring to FIGS. 7 and 7A, the condenser coil 204 is comprised of a metal coil tube 210 and a tape of absorptive material 202 spirally wound round the metal coil tube 210. Alternatively, the absorptive material 202 can be made in the form of a sleeve and sleeved onto the condenser coil 204. The absorptive material 202 can be obtained from non-woven cloth, cloth, natural fibers, synthetic fibers, reclaimed fibers, inorganic fibers, etc.

Figure 8:
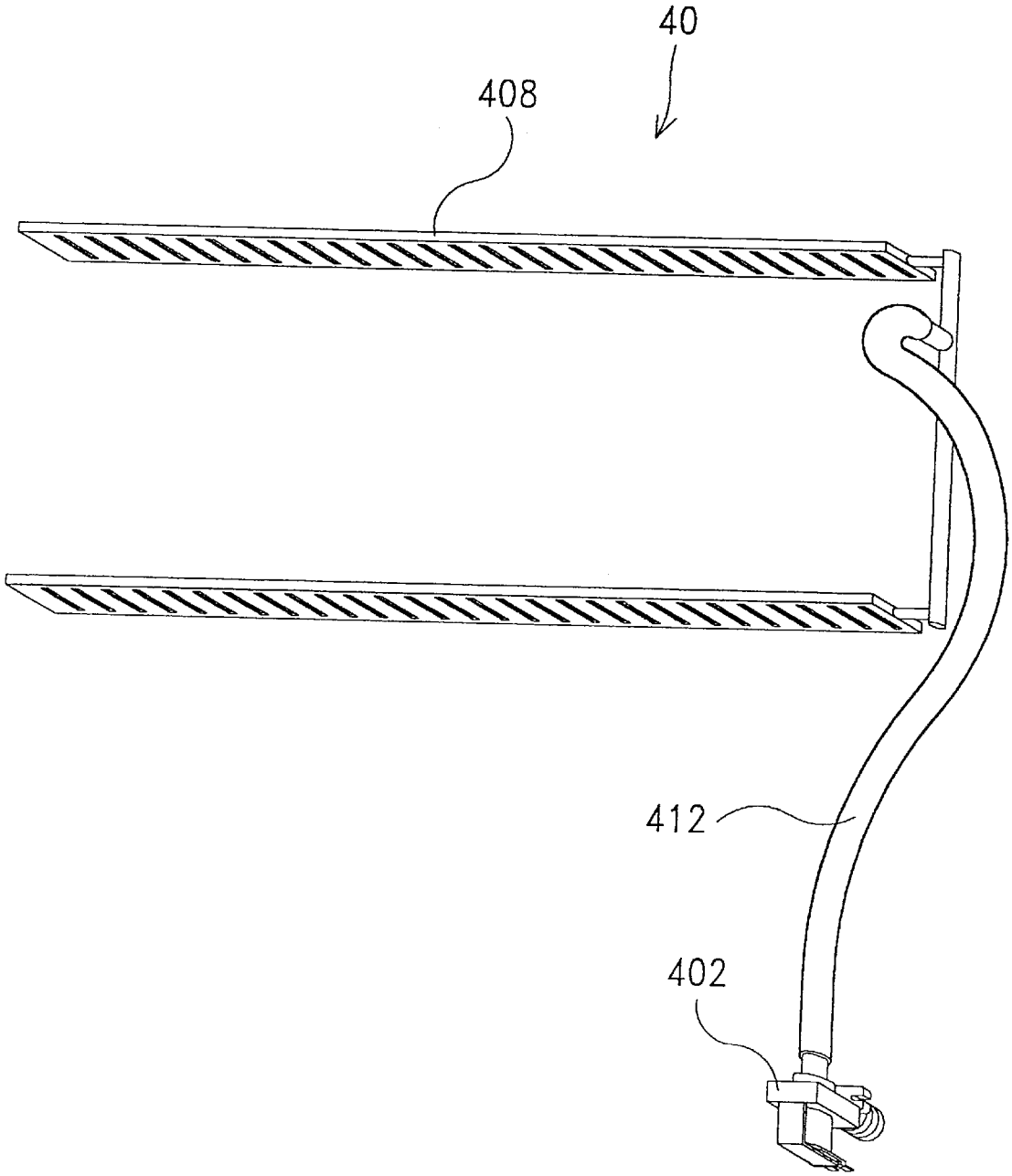
FIG. 8 is a schematic drawing showing the arrangement of the water spray tubes, water supply pipe and electromagnetic valve of the water supply system according to the present invention.

Referring to FIG. 8, the water spray tubes 408 can be round tubes or flat tubes. The water outlets of the water spray tubes 408 can be designed having a narrow elongated shape, or a circular shape. Each water spray tube 408 has a diameter gradually reducing from the water supply pipe 412 toward the end, so that cooling water can evenly be distributed to the evaporative condensing unit 20.

As indicated above, the evaporative condensing unit 20 is comprised of a plurality of condenser coils 204, each condenser coil 204 comprising a metal coil tubes 210 covered with a layer of absorptive material 202. When cooling water is delivered out of the water spray tubes 408 of the water supply system 40, it is absorbed by the absorptive material 202 of the condenser coil 204 for heat exchange with the cooling agent passing through the metal coil tubes 210 of the condenser coils 204, permitting heat to be quickly carried away by currents of air passing through the air gaps 212 in the evaporative condensing unit 20. Because the electromagnetic valve 402 of the water supply system 40 is controlled by the control PC board 404, the amount of cooling water supplied from the water supply system 40 to the evaporative condensing unit 20 can be controlled approximately equal to the amount of water being evaporated during the operation of the machine.

Figure 9:
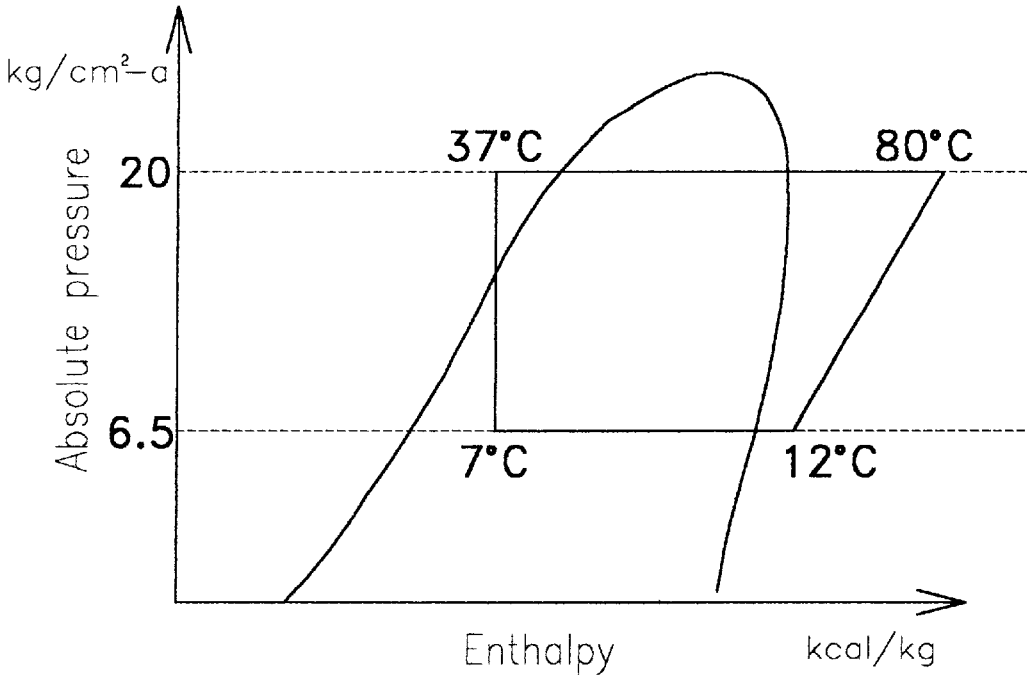
FIG. 9 is a R-22 Mollier diagram obtained from a conventional condenser unit.
Figure 10:
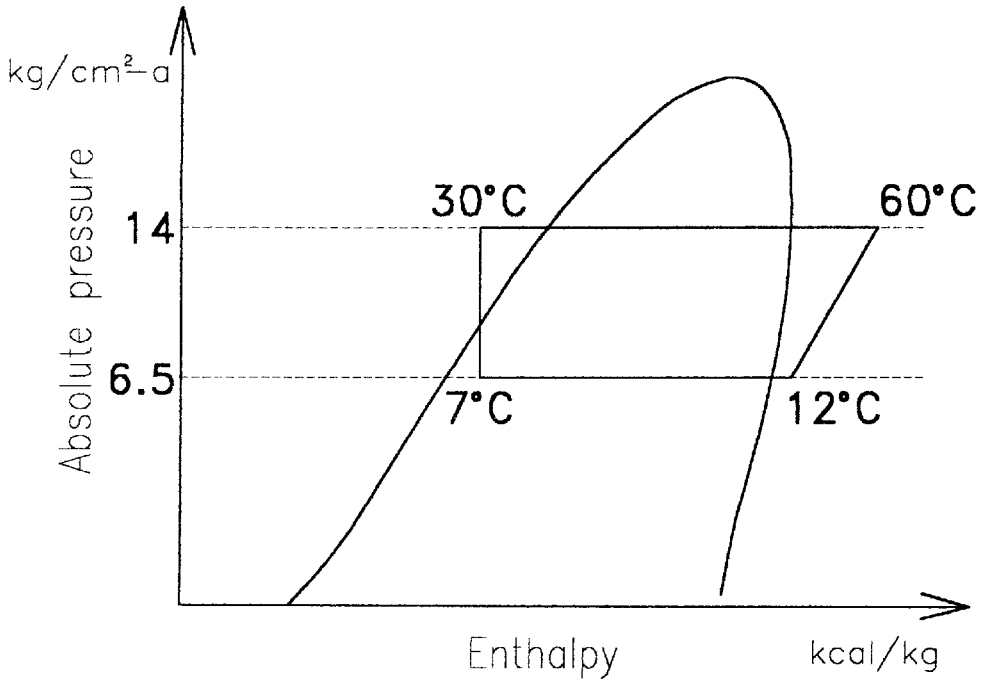
FIG. 10 is a R-22 Mollier diagram obtained from an evaporative condensing unit according to the present invention.

FIG. 9 illustrates a R-22 Mollier diagram obtained from a conventional condenser unit. FIG. 10 illustrates a R-22 Mollier diagram obtained from an evaporative condensing apparatus according to the present invention. In FIG. 9, the temperature of the gas state cooling agent at the input port of the condenser unit is about 80° C., the temperature of the liquid state cooling agent at the output port of the condenser unit is about 37° C., and the condensing pressure is about 20 $kg/cm^2$-a. In FIG. 10, the temperature of the gas state cooling agent at the input port of the evaporative condensing apparatus is about 60° C., the temperature of the liquid state cooling agent at the output port of the evaporative condensing apparatus is about 30° C., and the condensing pressure is about 14 $kg/cm^2$-a (theoretically the condensing pressure if R-22 at 30° C. is about 12.27 $kg/cm_2$-a, see FIG. 1). Because the compression ratio is greatly reduced, the temperature of the condensed cooling agent can be reduced by about 7° C., therefore the efficiency is improved by about 20%. Because the compression ratio is greatly reduced, the consuming power of the compressor 10 can be reduced by about 25% in comparison with an equivalent conventional unit. Therefore, the evaporative condensing apparatus of the present invention can greatly reduce the power consumption of an air conditioner or refrigerator, and greatly improve its EER (or COP) value by about 50%. According to tests made on model RC870489, which is obtained from Shuan-Shih Electric Engineers Taiwan, at Air-conditioner Department of Hsu-lin Laboratory of Taiwan Power Research and Test Center, the EER value is as high as 4.027 kca/h.W (COP 4.68). In comparison with equivalent conventional devices, it saves power consumption by about 40%.

Figure 11:
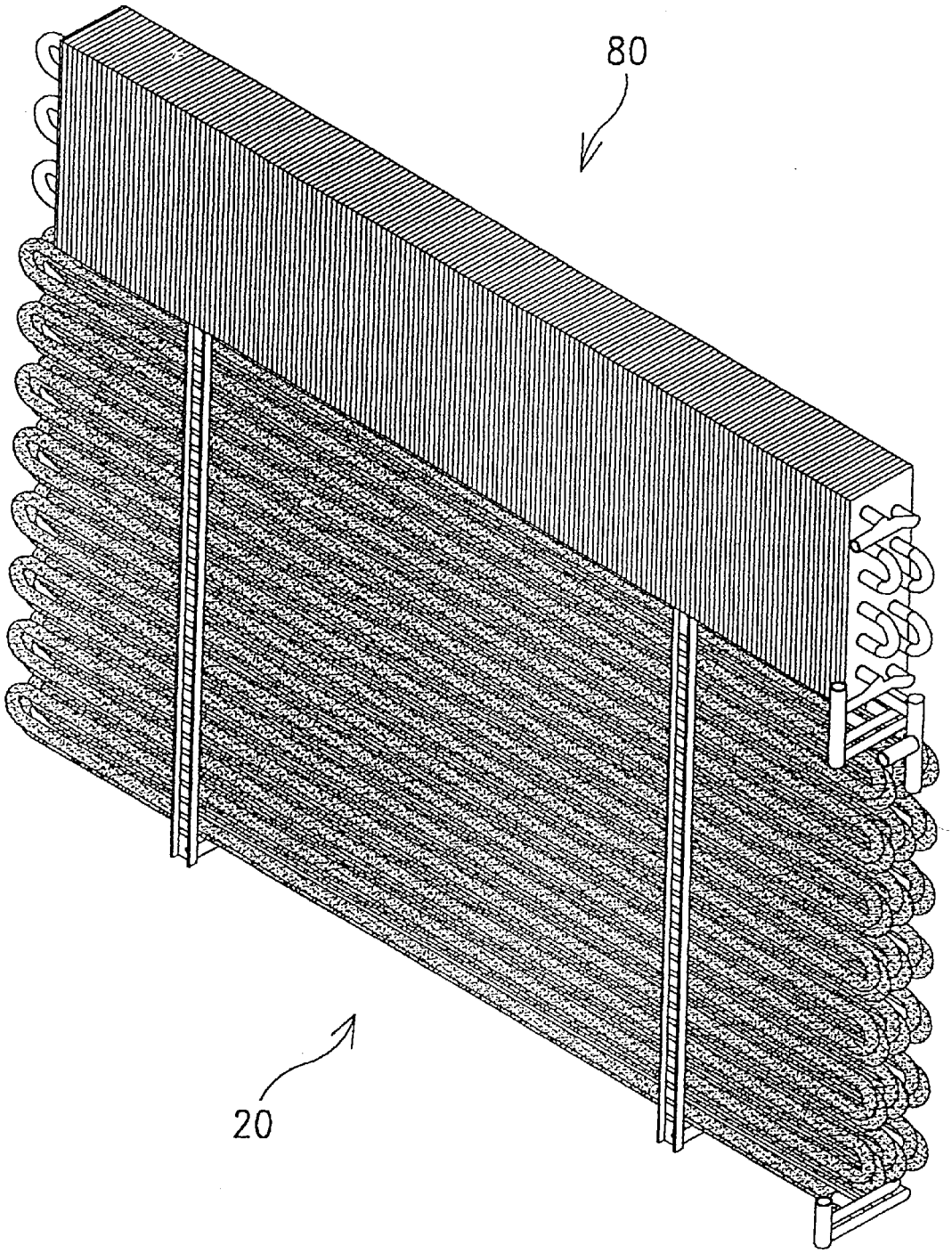
FIG. 11 is a perspective view of a combination of condensing device according to the present invention.

Referring to FIG. 11, the evaporative condensing unit 20 can be attached to a regular air cooling condenser 80 to form a combination of condensing device.

It is to be understood that the drawings are designed for purposes of illustration only, and are not intended as a definition of the limits and scope of the invention disclosed.

What the invention claimed is:

1. An evaporative condensing apparatus comprising:

an evaporative condensing unit for condensing a gas state cooling agent into a liquid state, said evaporative condensing unit comprising a plurality of condenser coils having absorptive means covered thereon;

a low compression ratio compressor controlled to pump the gas state cooling agent into said evaporative condensing unit;

a water supply system having a control PC board and an electromagnetic valve controlled by said control PC board to deliver cooling water from a water source to the layer of absorptive material of each of said condenser coils of said evaporative condensing unit; and, a condenser fan having a fan motor and a fan blade unit driven by said fan motor to draw currents of air through gaps in the condenser coils of said evaporative condensing unit for carrying heat away from said evaporative condensing unit;

said control PC board of said water supply system including a selector switch for high, medium and low water pressure selections, said control PC board operating said electromagnetic valve in coordination with operation of said low compression ratio compressor to periodically supply water to said evaporative condensing unit in an amount approximately equal to an amount of water being evaporated.

2. The evaporative condensing apparatus of claim 1 wherein said water supply system further comprises a manual switch controlled to selectively continuously supply water to said evaporative condensing unit for washing said evaporative condensing unit.

3. The evaporative condensing apparatus of claim 1 wherein said condenser coils are formed of a metal coil tube and a layer of absorptive material formed by an absorptive material tape spirally wound on the periphery of said metal coil tube.

4. An evaporative condensing apparatus comprising:

an evaporative condensing unit for condensing a gas state cooling agent into a liquid state, said evaporative condensing unit comprising a plurality of condenser coils having absorptive means covered thereon;

a low compression ratio compressor controlled to pump the gas state cooling agent into said evaporative condensing unit;

a water supply system having a control PC board and an electromagnetic valve controlled by said control PC board to deliver cooling water from a water source to the layer of absorptive material of each of said condenser coils of said evaporative condensing unit, said water supply system including a water supply pipe having a water input end connected to said electromagnetic valve and a water output end, and a plurality of water spray tubes respectively connected to the water output end of said water supply pipe for guiding cooling water to said condenser coils, said water spray tubes each having a diameter gradually reduced from said water supply pipe to a distal end thereof, a plurality of water outlets respectively facing said condenser tubes, and an absorptive material provided at said water outlets; and, a condenser fan having a fan motor and a fan blade unit driven by said fan motor to draw currents of air through gaps in the condenser coils of said evaporative condensing unit for carrying heat away from said evaporative condensing unit.

* * * * *